United States Patent [19]

Nickel

[11] Patent Number: 4,735,627

[45] Date of Patent: Apr. 5, 1988

[54] METHOD FOR FINISHING KNITTED FABRIC

[75] Inventor: Friedhelm Nickel, 2800 Bremen 44, Fed. Rep. of Germany

[73] Assignee: Hansa Textilchemie GmbH, Oyten, Fed. Rep. of Germany

[21] Appl. No.: 936,175

[22] Filed: Dec. 1, 1986

[30] Foreign Application Priority Data

Dec. 19, 1985 [DE] Fed. Rep. of Germany ..... 3544958

[51] Int. Cl.[4] ..... D06M 13/34

[52] U.S. Cl. ..... 8/188; 8/115.6; 8/115.66

[58] Field of Search ..... 8/115.66, 115.6, 188

[56] References Cited

U.S. PATENT DOCUMENTS 3,910,759 10/1975 Sthare et al. ..... 8/115.6

*Primary Examiner*—Paul Lieberman
*Assistant Examiner*—John F. McNally
*Attorney, Agent, or Firm*—Toren, McGeady

[57] ABSTRACT

A method is disclosed for finishing knitted fabric to prevent cut edges from rolling up while the knitted fabric is being converted into garments. 0.2 to 1 percent, based on the weight of the knitted fabric, of a copolymer of N-vinylpyrrolidone and dialkylaminoalkyl acrylate or methacrylate, the alkyl groups preferably being lower alkyl groups with 1 to 4 carbon atoms and at least 10% of the amino groups being present in the quaternary form, is applied to the knitted fabric. The copolymer is preferably applied to the fabric from an aqueous solution.

11 Claims, No Drawings

METHOD FOR FINISHING KNITTED FABRIC

FIELD OF INVENTION

This invention generally relates to fabric finishing and is particularly directed to a method for preventing the curling or rolling-up (hereinafter "rolling") of the cut edges of knitted fabrics while the fabric is being converted into finished articles, such as garments, curtains and the like. The term "knitted fabric" is used herein in a broad sense and is deemed to include any two-dimensional open-meshed or loop-containing textile goods by whatever textile method it may be produced.

BACKGROUND INFORMATION AND PRIOR ART

It is a well known, annoying property of knitted fabrics, especially of fine knitted fabrics, that they have the tendency to roll at the cut edges while being cut to size and shape. The further processing of the cut goods, for example, by sewing, is thus hampered significantly.

Attempts have been made to stabilize or reinforce the cut edges of knitted fabric by gluing, so that rolling does not take place. This method can, however, be used only for parts of relatively large area. Such large area parts are formed, for example, if the knitted fabric is first produced in the form of an endless tube, which is then cut open at a longitudinal side. The method fails when piece goods, obtained in such a manner, are converted into garments, because the cut edges that are formed when cutting to size and shape cannot be glued.

In U.S. Pat. No. 4,318,956, a method is described for finishing polyester woven or knitted goods, in which the textiles are treated with a polymer, which contains free amino groups or salts thereof as well as carboxyl groups. The polymer is cured on the fiber at elevated temperatures. The ratio of amino or amine salt groups to carboxyl groups should be 100:1 to 1:1. The polymers do not contain any quaternary nitrogen atoms. The polyester woven or knitted fabrics, treated with these polymers, have improved soil-release properties.

In European Offenlegungsschrift 0,129,322,a method is described to improve the shrinkproofness of wool. For this purpose, the wool is first subjected to an oxidative pretreatment and then treated with the aqueous solution of a polymer, which contains quaternary ammonium groups, which are derived especially from the aminoacrylate monomer. The wool, so treated, is then dried.

OBJECTS OF THE INVENTION

It is a primary object of the invention to provide finishing agents for knitted fabrics which, when applied to the fabric, successfully prevent the undesired rolling in the area of the cut edges when the fabric is further processed without affecting in any way other characteristics of the fabric such as its feel or hand (hereinafter "hand").

Another object of the invention is to provide a method for applying such finishing agents to the fabric in a simple manner without requiring any complicated apparatus.

It is also an object of the invention to provide a procedure wherein the finishing agents are applied to the fabric from an aqueous solution.

Still another object of the invention is to provide finishing agents which impart the fabric with the desired results in small quantities.

It is moreover an object of the invention to provide a procedure of the indicated kind which can readially be carried out by the manufacturer of the fabric during the manufacturing procedure without negatively affecting the further handling of the fabric.

Generally, it is an object of the invention to improve on the art of finishing knitted fabrics as previously practiced.

It will be appreciated that the above objects are not attained by the prior art referred to.

SUMMARY OF THE INVENTION

The above objects are fully achieved in accordance with this invention by applying to the knitted fabric 0.2 to 1 weight percent, based on the weight of the fabric, of a copolymer of N-vinylpyrrolidone and dialkylaminoalkyl acrylate or dialkylaminoalkyl methacrylate, the alkyl groups preferably being lower alkyl groups with 1 to 4 carbon atoms and at least 10% of the amino groups being present in the quaternary form. The alkyl groups preferably are methyl or ethyl.

In a particularly preferred embodiment of the invention, the method is carried out with copolymer of N-vinylpyrrolidone and dimethylaminoethyl methacrylate with at least 10% of the amino groups present in the quaternary form.

Copolymers of 90 to 98 mole percent of N-vinylpyrrolidone and 10 to 2 mole percent of dialkylaminoalkyl acrylate or methacrylate give excellent results.

The copolymers should preferably have a molecular weight greater than 100,000, especially one greater than 500,000 and more particularly one that is not less than 1,000,000.

The copolymers are applied on the knitted fabric preferably from an aqueous solution, for example, by means of conventional dyeing equipment such as winch vats. For this purpose, solutions containing 0.01 to 1.0 weight percent of active ingredient are used. The active ingredient is picked up by or exhausted onto the knitted fabric because of its substantivity.

The knitted fabric, finished in accordance with the inventive method can be converted into finished articles such as garments in any manner without any rolling of the cut edges, which are formed when the fabric is cut to size and shape. The finished knitted fabric retains its flat shape and can therefore be processed further, especially sewn, without difficulties. A substantially higher processing speed can thus be achieved.

The knitted fabric, finished in accordance with the invention, shows no change in hand that might be considered annoying. It can be sewn satisfactorily, since the remaining properties of the finished knitted fabric are not changed. It is therefore not necessary to remove the high molecular weight compounds from the knitted fabric after it has been processed. Since the effect of preventing the rolling of the cut edges is achieved already with very low add-ons of polymeric compounds, the product hardly becomes more expensive. The increase in price, which at most is slight, is more than compensated for by the substantially higher processing speed.

The inventive process is described in greater detail by the following example, it being understood that the example is given by way of illustration and not limitations.

EXAMPLE

Light knitted cotton goods in tubular form are treated in a winch vat for 10 minutes with 0.5% solutions of the polymers (a) to (g) at a temperature of 20° C. and a liquor pH of about 6. Subsequently, the knitted tubes are dewatered in the usual manner, cut open and dried for about 3 minutes at 130° C. on a tenter frame.

The evaluation of the knitted fabrics is given in the following Tables. It is evident from the Tables that a polymer of N-vinylpyrrolidone alone (polymer e) has no effect on the rolling behavior of the treated knitted fabric. Dimethylaminoethyl methacrylate can be polymerized to homopolymers having a molecular weight of only about 135,000. If such a homopolymer is used (polymer f), the rolling behavior of the treated knitted fabric is improved; however, the treated knitted fabric has an unacceptably hard hand.

Copolymers of N-vinylpyrrolidone and dimethylaminoethyl methacrylate, which do not have any quaternary ammonium groups, are not exhausted or picked up adequately.

In view of these comparison experiments, it was therefore surprising that the copolymers, used in the inventive process, not only have good pick-up properties, prevent rolling of the cut edges and do not have a negative effect on the hand of the fabric, but rather improve the hand of the fabric.

TABLE

| Polymer | N—vinylpyrrolidone Mole % | Dialkylaminomethyl Methyacrylate Mole % | Alkyl = | N, Quaternized with dimethyl Sulfate Mole % | Average Molecular Weight |
|---|---|---|---|---|---|
| a* | 98 | 2 | methyl | 80 | 500,000 |
| b* | 95 | 5 | methyl | 80 | 1,500,000 |
| c* | 93 | 7 | methyl | 80 | 1,000,000 |
| d* | 95 | 5 | ethyl | 10 | 100,000 |
| e** | 100 | — | — | — | 1,100,000 |
| f** | — | 200 | methyl | 30 | 135,000 |
| g** | 95 | 5 | ethyl | — | 1,200,000 |

*of the invention
**not of the invention

TABLE 2

| Polymer | Rolling-Up of Cut Edges none | slight | mod. | severe | Hand | Exhaustion Behavior (Pick-up) |
|---|---|---|---|---|---|---|
| — | | | | + | limp, somewhat rough. | — |
| a* | | + | | | somewhat fuller, softer. | almost complete liquor exhaustion |
| b* | + | | | | pleasant, soft. | complete bath exhaustion |
| c* | + | | | | pleasant, soft. | complete bath exhaustion |
| d* | | + | | | somewhat limp, soft. | good bath exhaustion |
| e** | | | | + | unchanged | slight bath exhaustion |
| f** | | + | | | hard | good bath exhaustion |
| g** | | | + | | somewhat softer | incomplete exhaustion of the polymer in the given time |

*of the invention
**not of the invention

I claim:

1. Method for finishing knitted fabric to prevent cut edges from rolling while the knitted fabric is being converted into finished articles, which comprises applying to the fabric 0.2 to 1 weight percent, based on the weight of the knitted fabric, of a copolymer of N-vinylpyrrolidone and dialkylaminoalkyl acrylate or dialkylaminoalkyl methacrylate, at least 10% of the amino groups being present in the quaternary form.

2. The method of claim 1, wherein the alkyl groups are lower alkyl with 1 to 4 carbon atoms.

3. The method of claim 2, wherein a copolymer of N-vinylpyrrolidone and dimethylaminoethyl methacrylate, at least 10% of the amino groups of which are present in the quaternary form, is applied.

4. The method of claim 2, wherein a copolymer of 90 to 98 mole percent N-vinylpyrrolidone and 10 to 2 mole percent dialkylaminoalkyl acrylate or dialkylaminoalkyl methacrylate is applied.

5. The method of claim 2, wherein a copolymer having a molecular weight greater than 100,000 is applied.

6. The method of claim 2, wherein a copolymer having a molecular weight greater than 500,000 is applied.

7. The method of claim 1, wherein the copolymer is applied to the fabric from an aqueous solution.

8. A method for preventing the rolling of cut edges of knitted fabric, which comprises immersing the fabric in an aqueous solution containing an effective amount of a copolymer of N-vinylpyrrolidone and dialkylaminoalkyl acrylate or dialkylaminoalkyl methacrylate, the alkyl groups being lower alkyl with 1 to 4 carbon atoms and at least 10% of the amino groups being present in the quaternary form, said copolymer having a molecular weight greater than 500,000, and drying the fabric after it has been removed from the solution.

9. The knitted fabric obtained by the method of claim 1.

10. The knitted fabric obtained by the method of claim 2.

11. The knitted fabric obtained by the method of claim 8.

* * * * *